US006264511B1

(12) United States Patent
Bu

(10) Patent No.: US 6,264,511 B1
(45) Date of Patent: Jul. 24, 2001

(54) ARRANGEMENT OF CONTACTS AND CARRIERS

(75) Inventor: Xue Wu Bu, Shen-Zhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/491,702

(22) Filed: Jan. 26, 2000

(30) Foreign Application Priority Data

Dec. 21, 1999 (TW) ..... 088122587

(51) Int. Cl.[7] ..... H01R 13/02
(52) U.S. Cl. ..... 439/885
(58) Field of Search ..... 439/885, 637, 439/60

(56) References Cited

U.S. PATENT DOCUMENTS 5,176,545 * 1/1993 Brown ..... 439/885
5,376,026 * 12/1994 Ohashi ..... 439/885
5,779,507 * 7/1998 Yeh ..... 438/885
5,788,544 * 8/1998 Drekmeier et al. ..... 439/885
5,848,920 * 12/1998 Klein et al. ..... 439/885

* cited by examiner

*Primary Examiner*—Gary F. Paumen
(74) *Attorney, Agent, or Firm*—Wei Te Chung

(57) ABSTRACT

A carrier strip arrangement includes a pair of first and second carrier sub-arrangements connecting with each other by a plurality of connecting webs. Each of the first and second carrier sub-arrangements contains a carrier strip and a plurality of contacts connected with the carrier strip. Each contact of the first carrier sub-arrangement is a mirror image of and is connected with a corresponding contact of the second carrier sub-arrangement by a pair of connecting webs. Thus, the carrier strip arrangement achieves good stabilization by employing the connecting webs transversely connecting with the corresponding contacts of the first and second rows thereby effectively preventing the contacts from deformation and warpage during package and transportation.

1 Claim, 3 Drawing Sheets

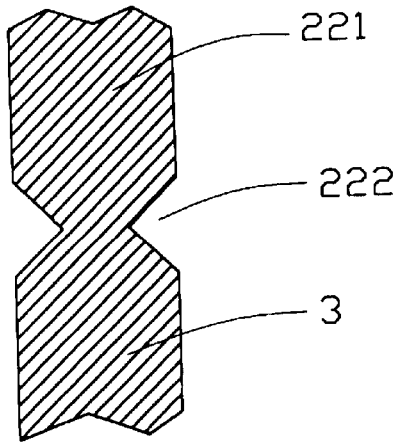
FIG. 2
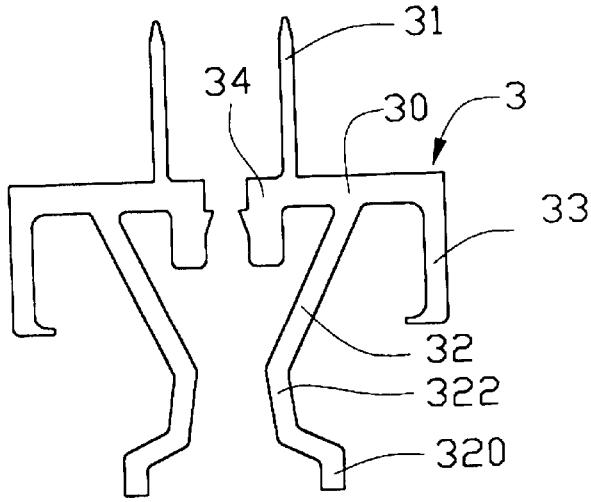
FGI. 3

ARRANGEMENT OF CONTACTS AND CARRIERS

BACKGROUND OF THE INVENTION

The present invention relates to a carrier strip arrangement, and particularly to a carrier strip arrangement which provides excellent protection over the contacts formed/stamped thereon.

Since more and more complicated contacts are employed in electrical connectors for achieving high performance, more strict requirements are presented as to the manufacturing process of the contacts. The complicated contacts often form many inclined or curved structures thereof. Generally, the contact has a complicated contour, including inclined and/or curved section. The complicated contacts are usually stamped from a sheet of metal and arranged in regularly repetitive and sequential order thereby forming a carrier strip arrangement. A carrier strip arrangement typically includes a guiding structures, for example the guiding perforations, and the formed contacts attached thereto are presumed to be protected by those guiding perforations.

However, since the carrier strip arrangement only contains a single carrier strip connecting with the contacts at a single side, the carrier arrangement accordingly is apt to deformations and warpage in package and transportation owing. Furthermore, when plating the carrier arrangement, more plating material may be wasted due to the deformation and warpage caused by the poor stabilization of the carrier arrangement since the contacts is connected with the single carrier strip at only the single side. Moreover, when the carrier strip arrangement is served as a contact feeding during assembly process of a connector, the carrier strip can only be held on a single side thereby lowing down the manufacturing process.

Therefore, an improved carrier strip arrangement is required.

BRIEF SUMMARY OF THE INVENTION

A main object of the present invention is to provide a carrier arrangement employing double carriers connecting with complicated contacts therebetween thereby preventing the carrier arrangement from deformation and warpage during the course of package and transportation.

Another object of the present invention is to provide a carrier strip arrangements having good stabilization thereof thereby ensuring good plating quality by introducing double carriers to connect with complicated contacts therebetween.

Another object of the present invention is to provide a carrier arrangement which can increase the producing capacity of manufacture, especially of the plating process thereof by introducing a double-carrier structure.

Another objective of this invention is to provide a carrier strip arrangement which effectively protect contacts formed thereof during shipment.

Still another objective of this invention is to provide a carrier strip which can be firmly held when served as a feeding, thereby increasing the production capacity.

A carrier strip arrangements in accordance with the present invention comprises a pair of first and second carrier strip sub-arrangements connecting with each other by a plurality of connecting webs. Each of the first and second carrier sub-arrangements contains a carrier strip and a plurality of contacts connected with the carrier strip. Each contact of the first carrier strip sub-arrangement is a mirror image of and is connected with a corresponding contact of the second carrier strip sub-arrangement by a pair of connecting webs. Thus, the carrier strip arrangement achieves good stabilization by employing the connecting webs transversely connecting with the corresponding contacts of the first and second rows thereby effectively preventing the contacts from deformation and warpage during package and transportation.

Other objects, advantages and novel features of the invention will become more apparent from the following detailed description when taken in conjunction with the accompanying drawings.

BRIEF DESCRIPTION OF THE DRAWINGS

FIG. 2 is a cross-sectioned view along line 2—2 in FIG. 1;

FIG. 3 is a planar view of a pair of contacts of FIG. 1; and

DETAILED DESCRIPTION OF THE INVENTION

Figure 1:
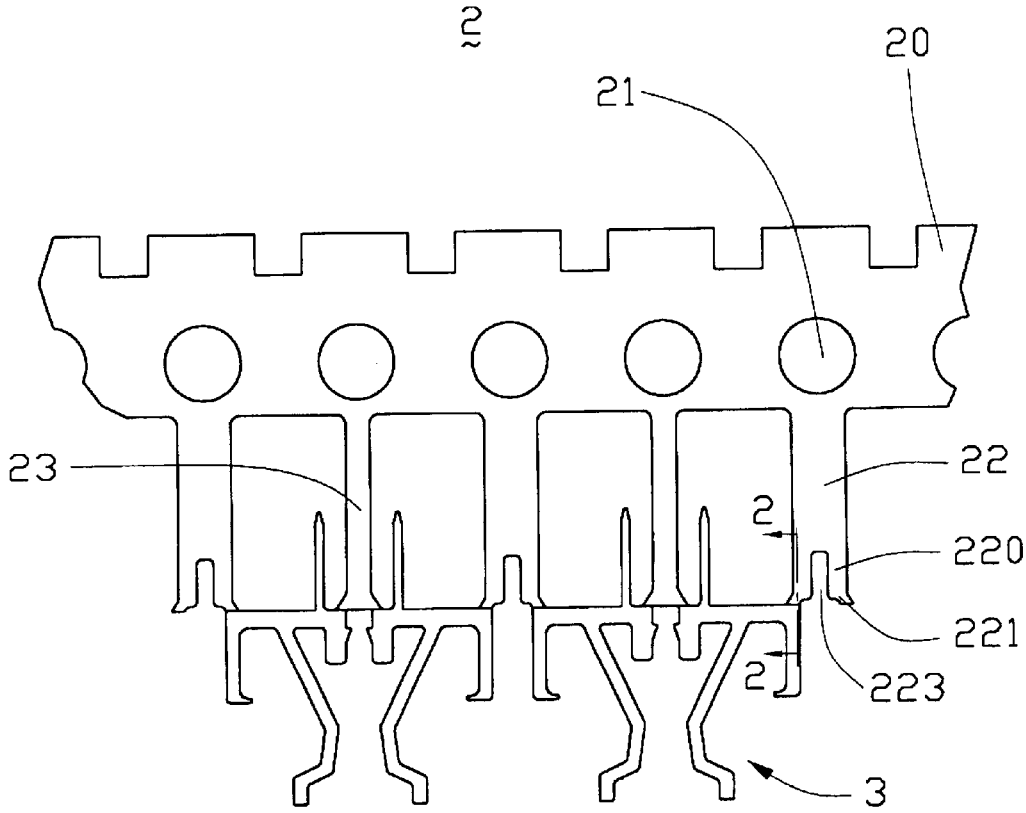
FIG. 1 is a planar view of a carrier sub-arrangement for contact.
Figure 4:
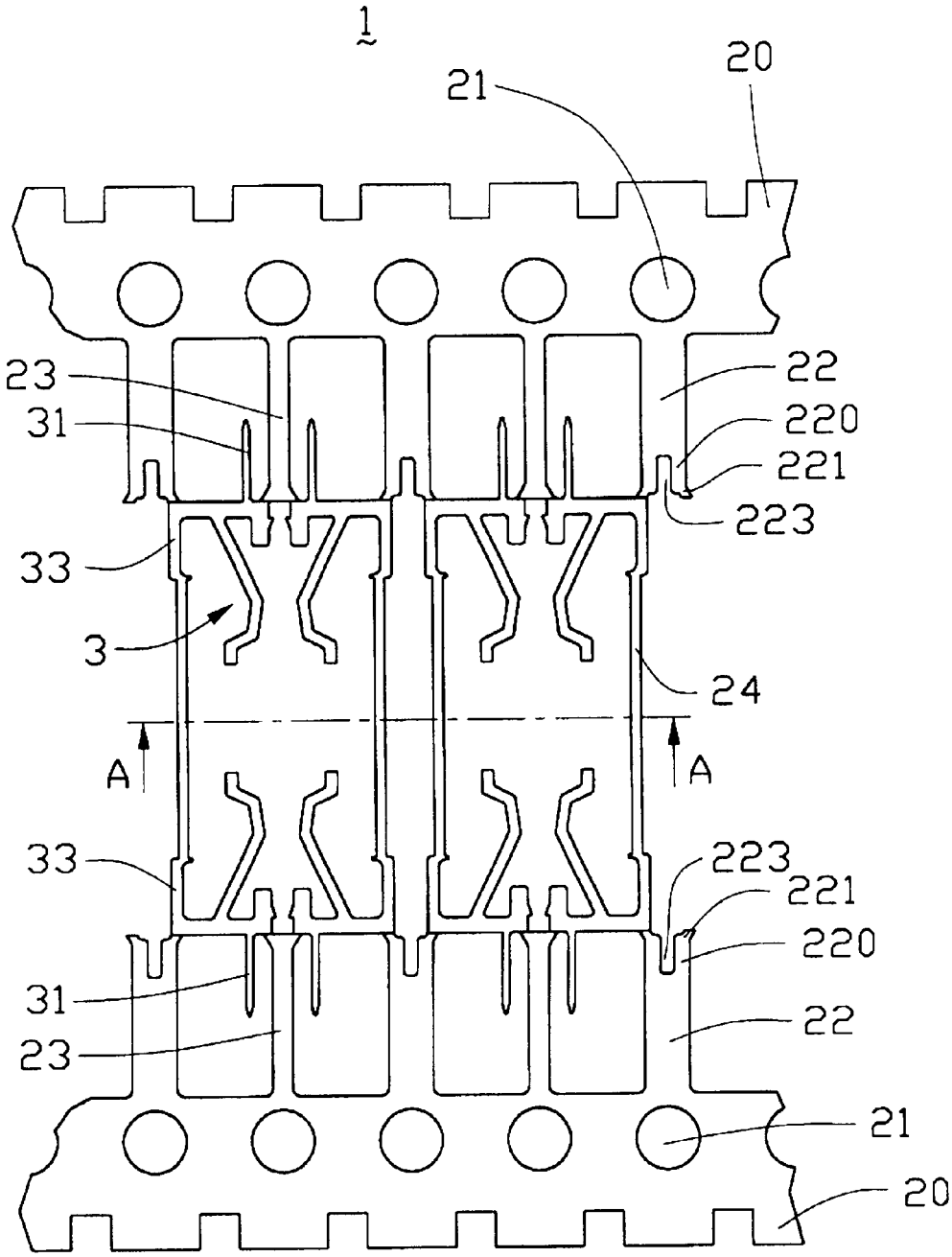
FIG. 4 is a planar view of a carrier arrangement comprising a pair of the carrier sub-arrangements connecting with each other of FIG. 1.

Referring to FIGS. 1 and 4, a carrier arrangement 1 in accordance with the present invention comprises a pair of carrier strip sub-arrangements 2 parallel to each other by a plurality of connecting webs 24. Each carrier sub-arrangement 2 includes a carrier strip 20 and a pair of contacts 3 connected with the carrier strip 20. The carrier strip 20 has a plurality of guiding openings 21 for engaging with corresponding structures of a mold (not shown) and a plurality of first connecting arms 22 each for connecting the carrier strip 20 with a pair of corresponding contacts 3. Each first connecting arm 22 outwardly extends from the carrier strip 20 and forms a pair of connecting lugs 220 at an end thereof for respectively connecting with a corresponding contacts. A cutout 223 is defined between the pair of connecting lugs 220. A connecting finger 221 is formed at a joining junction between each connecting lug 220 and the corresponding contact 3. A second connecting arm 23 extends from the carrier strip 20 between two adjacent first connecting arms 22 for connecting a pair of contacts respectively connected by the adjacent first connecting arms 22.

Referring also to FIG. 3, a pair of contacts 3 is provided. The pair of contacts 3 are connected with each other and together with the carrier strip 20 by a corresponding second connecting arm 23 and is substantially mirror images of each other. Each contact 3 comprises a base 30, a contact arm 32 outwardly extending from a middle portion of the base 30, and a secondary arm 33 extending in a direction substantially the same as the contact arm 32 from an end of the base 30. A retention arm 34 forming barbs thereon extends substantially parallel to the secondary arm 33 from the other end of the base 30 opposite to the secondary arm 33. A connecting/tail section 31 outwardly extends from the base 30 opposite to the contact arm 32, the secondary arm 33 and the retention arm 34. The contact arm 32 of each contact 3 forms a curved contacting section 322 and an abutting distal 320 curved relative to the contacting section 322.

Each of the pair of contacts 3 of FIG. 3 is also connected with the carrier strip 20 by a corresponding first connecting arm 22 at the end of the base 30 of the contact 3 near the secondary arm 33 opposite to the second connecting arm 23.

It is noted that the first and second connecting arms 22, 23 can be easily disconnected from the contacts 3 with traditional methods when installing the contacts into the corresponding cavities of the connector (not shown). For example, as shown in FIG. 2, a pair of V-shaped cutouts is defined on opposite sides of a jointing junction between the connecting finger 221 of the first connecting arm 22 and the corresponding contact 3. The same is of the second connecting arm 23. Thus, the carrier strip 20 and the first and second connecting arms 22, 23 can be readily separated from the contacts 3.

Referring back to FIG. 4, the pair of carrier sub-arrangements 2 of the carrier strip arrangement 1 is mirror imaged to each other relative to a symmetrical line A—A. Each connecting web 24 is connected with the corresponding secondary arms 33 of corresponding contacts 3 mirror imaged to each other relative to the symmetrical line A—A.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact carrier strip arrangement comprising:

a pair of first and second contact carrier sub-arrangements arranged in a same plane and a plurality of connecting webs interconnected between the first and the second contact carrier sub-arrangements, the first and second contact carrier sub-arrangements being mirror imaged with each other with respect to the connecting webs; each contact carrier sub-arrangement including a carrier strip being stamped and formed out of a sheet of metal, a plurality of first and second connecting arms extending from the carrier strips; and a plurality of contacts being connected with the first and second connecting arms of the carrier strip, each contact forming at least one curved portion; wherein each connecting web connects a contact of the first contact carrier sub-arrangement with a corresponding contact of the second contact carrier sub-arrangement, thereby preventing the at least one curved portion of each contact of the contact carrier arrangement from deformation;

wherein the at least one curved portion of each contact includes a curved contact arm;

wherein each contact of the contact carrier arrangement includes a base, the curved contact arm outwardly extending from the base, and another arm outwardly extending from the base;

wherein each connecting web connects the secondary arm of a contact of the first contact carrier arrangement with the secondary arm of a corresponding contact of the second contact carrier arrangement;

wherein each first connecting arm of the carrier strip forms a pair of spaced connecting lugs at an end thereof for respectively connecting with a different contact, and a cutout between the pair of spaced connecting lugs, a connecting finger being formed at a distal end of each connecting lug for connecting with a corresponding contact;

wherein a pair of V-shaped cutouts is defined on opposite sides of a joining junction between a connecting finger of a connecting arm of one of the carrier strips and a corresponding contact, thereby facilitating the carrier strip to be easily disconnected from the contact;

wherein each second connecting arm connects a pair of contacts together with a corresponding carrier strip of the first and second contact carrier arrangements;

wherein the pair of contacts is a mirror image of each other relative to the second connecting arm of the carrier strip;

wherein each carrier strip comprises a plurality of guiding perforations.

* * * * *